US008807344B2

(12) United States Patent
Keaton et al.

(10) Patent No.: US 8,807,344 B2
(45) Date of Patent: Aug. 19, 2014

(54) ADJUSTABLE MAGNETIC SEPARATOR

(71) Applicant: Mid-American Gunite, Inc., Newport, MI (US)

(72) Inventors: Donald E. Keaton, Saint Clairsville, OH (US); Keith P. Masserant, Newport, MI (US); Lawrence I. Masserant, Newport, MI (US); Robert G. Harte, Ashland, KY (US)

(73) Assignee: Mid-American Gunite, Inc., Newport, MI (US)

( * ) Notice: Subject to any disclaimer, the term of this patent is extended or adjusted under 35 U.S.C. 154(b) by 0 days.

(21) Appl. No.: 13/800,493

(22) Filed: Mar. 13, 2013

(65) Prior Publication Data

US 2013/0240413 A1 Sep. 19, 2013

Related U.S. Application Data

(60) Provisional application No. 61/612,629, filed on Mar. 19, 2012.

(51) Int. Cl.
*B03C 1/12* (2006.01)

(52) U.S. Cl.
USPC ..... 209/223.2; 209/214

(58) Field of Classification Search
CPC ..... B03C 1/10; B03C 1/12; B03C 1/14; B03C 2201/18; B03C 2201/22
USPC ..... 209/39, 213, 214, 223.1, 232; 210/222, 210/223, 695
See application file for complete search history.

(56) References Cited

U.S. PATENT DOCUMENTS

| | | | | |
|---|---|---|---|---|
| 1,166,682 | A * | 1/1916 | Henderson | 209/223.2 |
| 1,729,008 | A | 9/1929 | Osborne et al. | |
| 2,176,784 | A | 10/1939 | Bowden | |
| 2,785,801 | A | 3/1957 | Laurila | |
| 2,992,737 | A * | 7/1961 | Buus | 209/223.1 |
| 3,438,495 | A | 4/1969 | Turnock | |
| 3,489,280 | A * | 1/1970 | Merwin et al. | 209/223.1 |
| 4,016,071 | A | 4/1977 | Paterson | |
| 4,359,382 | A * | 11/1982 | Morgan | 209/223.2 |
| 5,057,210 | A * | 10/1991 | Julius | 209/212 |
| 6,068,133 | A * | 5/2000 | Schonfeld et al. | 209/219 |
| 7,743,926 | B2 * | 6/2010 | Lewis-Gray | 209/223.2 |
| 8,196,751 | B2 * | 6/2012 | Shuttleworth et al. | 209/215 |
| 2006/0070922 | A1 | 4/2006 | LaVeine | |
| 2011/0163015 | A1 | 7/2011 | Shuttleworth et al. | |

FOREIGN PATENT DOCUMENTS

| | | |
|---|---|---|
| EP | 25568984 A1 | 8/2011 |
| WO | 96/21509 A2 | 7/1996 |

OTHER PUBLICATIONS

PCT Search Report dated Jun. 17, 2013 for corresponding PCT application PCT/US2013/032764 filed Mar. 18, 2013.

* cited by examiner

*Primary Examiner* — Joseph C Rodriguez
(74) *Attorney, Agent, or Firm* — Quinn Law Group, PLLC

(57) ABSTRACT

An adjustable magnetic separator and method is provided herein to process aggregate material including magnetic material into a magnetic portion having a predetermined magnetic susceptibility, and a non-magnetic portion. The method and system include configuring an adjustable magnet to provide an effective magnetic field at a separating surface of the magnetic separator corresponding to the predetermined magnetic susceptibility of the magnetic portion to be separated. The strength or intensity of the effective magnetic field may be varied by mechanically adjusting the position of the magnet array included in the adjustable magnet relative to a separating surface defined by the magnetic separator.

20 Claims, 3 Drawing Sheets

ADJUSTABLE MAGNETIC SEPARATOR

CROSS-REFERENCE TO RELATED APPLICATIONS

This application claims priority to and the benefit of U.S. Provisional Patent Application No. 61/612,629, filed on Mar. 19, 2012, which is hereby incorporated by reference in its entirety.

TECHNICAL FIELD

The present invention relates generally to the processing of aggregate material using magnetic separation to provide a magnetic product and a non-magnetic product, and more particularly to processing of slag materials to provide products of differing iron content.

BACKGROUND

Aggregate material containing magnetic material may be processed using magnetic separation to provide a magnetic portion and a non-magnetic portion. The aggregate material may be a slag material including a magnetic material such as iron, where the slag material may be processed using magnetic separation into a magnetic portion having relatively higher total iron content than the non-magnetic portion. Magnetic separation processing methods which incorporate fixed or permanent magnets may be limited in flexibility due to the fixed magnetic field strength and fixed position of the permanent magnets within a particular magnetic separator. A magnetic separator including an electromagnet may be configured to electrically adjust the strength of magnetic field used for separation, which may increase flexibility, however, at a significantly higher operating cost to power the electromagnet.

SUMMARY

An adjustable magnetic separator and method is provided herein to process aggregate material including magnetic material into a magnetic portion having a predetermined magnetic susceptibility, and a non-magnetic portion. The method and system include configuring an adjustable magnet to provide an effective magnetic field at a separating surface of the magnetic separator corresponding to the predetermined magnetic susceptibility of the magnetic portion to be separated. The strength or intensity of the effective magnetic field may be varied by mechanically adjusting the position of the magnet array included in the adjustable magnet relative to a separating surface defined by the magnetic separator. For example, the magnet array adjusted to a first position may provide a first effective magnetic field configured to separate a first magnetic portion characterized by a first magnetic susceptibility from the material being processed. The magnet array adjusted to a second position may provide a second effective magnetic field configured to separate a second magnetic portion characterized by a second magnetic susceptibility from the material being processed, where the intensity of the second effective magnetic field differs from the intensity of the first magnetic field such that at least one of the magnetic susceptibility and iron content of the first and second magnetic portions will differ.

In one example, the aggregate material may be a particulate material, which may be a slag material including ferrous particles having varying iron content. The magnetic susceptibility of each of the slag particles will vary with the iron content of the particle, such that magnetic separation may be used to process the slag material to provide a magnetic portion having a relatively higher iron content corresponding to a magnetic susceptibility, and a non-magnetic portion having a relatively lower iron content in comparison with the magnetic portion. The slag material may be processed by the adjustable magnetic separator to yield by-products having differing iron content, which may also be referred to herein as finished products, including at least a finished iron rich product and a finished low iron fines product.

By configuring the magnetic separator as an adjustable magnetic separator, the effective magnetic field strength at the separating surface of the magnetic separator may be varied by mechanically adjusting the position of a permanent magnet array adjacent to the separating surface, as further described herein, to configure the magnetic separator to provide a magnetic portion of a predetermined magnetic susceptibility and/or iron content. The capability to mechanically adjust the effective magnetic field strength provides advantages in efficiency, effectiveness, and cost. For example, a single adjustable magnetic separator may be substituted for a series of fixed magnet separators, where each of the fixed magnet separators is configured to provide an effective magnetic field strength within the range of adjustment of the adjustable effective magnetic field provided by the adjustable magnetic separator, reducing the amount of equipment required to process the aggregate material. A fixed permanent magnetic separator, as that term may be used herein, refers to a conventional permanent magnetic separator including a permanent magnet in a fixed, e.g., non-adjustable position configured to provide a fixed magnetic field strength at a separating surface to separate material having a magnetic susceptibility or iron content corresponding to the fixed magnetic field strength for which the fixed separator is configured.

The adjustable magnetic separator described herein may be discretely or continuously adjustable to provide a plurality of effective magnetic fields which may range in intensity from lower to higher than the field provided by the fixed separator, may be adjusted to compensate for variability in the incoming material, or may be configured for separation of material having a magnetic susceptibility or iron content other than that for which the fixed separator is configured. The adjustable magnetic separator may be configured to provide customized processing of the incoming material for specialty markets and applications. For example, the adjustable magnetic separator may be configured to provide a separated portion defined by a specific magnetic susceptibility corresponding to a predetermined iron content, which may further correspond to a predetermined specific gravity. Because the adjustable magnetic separator described herein uses a mechanical adjustment mechanism to change the position of the magnet array relative to the separating surface to modify the effective magnetic field, the cost of flexibility, e.g., the cost of changing the effective magnetic field is minimal, especially in comparison, for example, to a magnetic separator including an electromagnet adjustable to provide varying effective magnetic fields, but at significantly high operating and maintenance costs than the mechanically adjustable system described herein.

In an illustrative example, the adjustable magnet is included in an adjustable permanent magnetic separator configured as a magnetic drum separator. The example of a drum separator is intended to be non-limiting, and the adjustable permanent magnet may be configured for use in various types of magnetic separators including but not limited to magnetic drum separators including top feed, side feed, suspended drum and double drum separators, magnetic pulleys or pulley magnets, and magnetic belt separators including in-line and cross-belt separators.

A method is provided for magnetically separating an aggregate material. In an illustrative example, the method includes providing incoming material, which may be slag material, to an adjustable magnetic separator including an adjustable permanent magnet in a first position corresponding to a first effective magnetic field, and magnetically separating the incoming material into a first magnetic portion and a first non-magnetic portion. The method includes mechanically adjusting the position of the adjustable magnet to a second position corresponding to a second effective magnetic field. The method continues with providing one of the first magnetic portion and the first non-magnetic portion to the adjustable magnetic separator with the adjustable magnet in the second position and magnetically separating the incoming portion into a second magnetic portion and a second non-magnetic portion. In an example, one of the second magnetic portion and the second non-magnetic portion may be separated in a third phase separation using the magnetic separator with the adjustable magnet in a third position to separate the incoming portion into a third non-magnetic portion and a third magnetic portion. As described previously, this method provides a multiple stage, e.g., at least a two stage, magnetic separation process using a single magnetic separator by mechanically adjusting the position of the adjustable magnet to provide a different effective magnetic field strength at each stage of separation, thus reducing the amount of equipment required.

The method may include size classifying the incoming material into a plurality of sized groups prior to magnetically separating the material. The method includes magnetically separating each of the sized groups into a sized first magnetic portion and a sized first non-magnetic portion, then separating the sized first magnetic portion into a second sized magnetic portion and second sized non-magnetic portion, to provide products which are distinguished by iron content and particle size. Advantages of this method may include increased accuracy and efficiency of magnetic separation by limiting the size range of particles in each sized group, and the capability to adjust the intensity of the effective magnetic field to achieve the separation of the material at a specified iron content or magnetic susceptibility, to provide a product within a defined size range and defined iron content and/or magnetic susceptibility The above features and other features and advantages of the present invention are readily apparent from the following detailed description of the best modes for carrying out the invention when taken in connection with the accompanying drawings.

DETAILED DESCRIPTION

Figure 1:
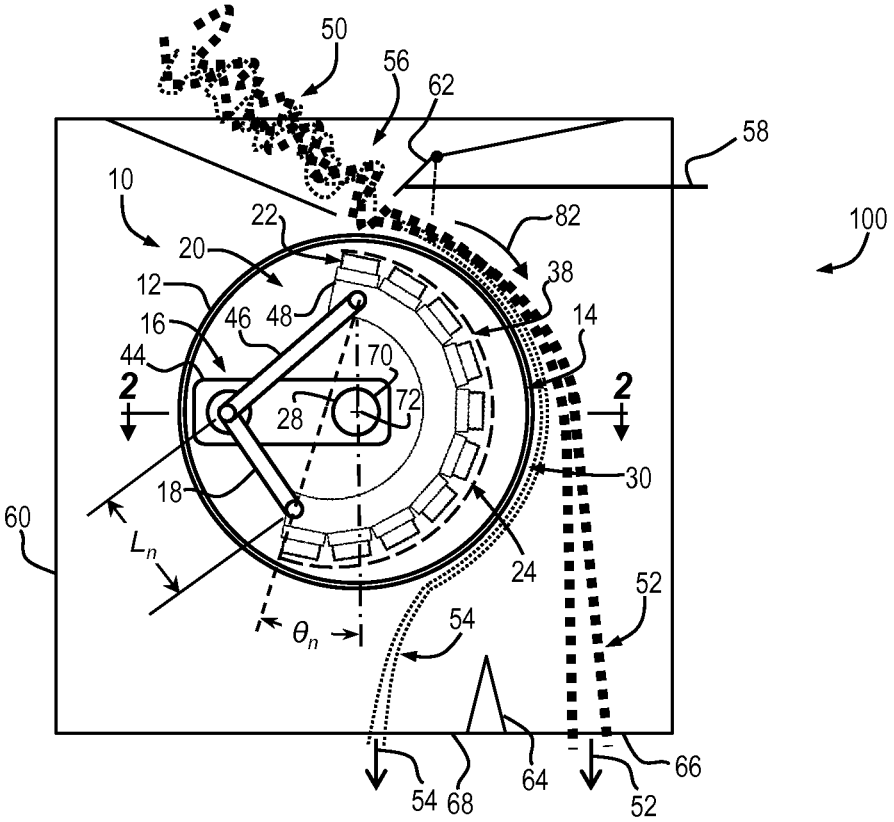
FIG. 1 is a schematic view of a magnetic separation system including a magnetic separator housing an adjustable magnet adjusted from a baseline position shown in FIG. 3.
Figure 2:
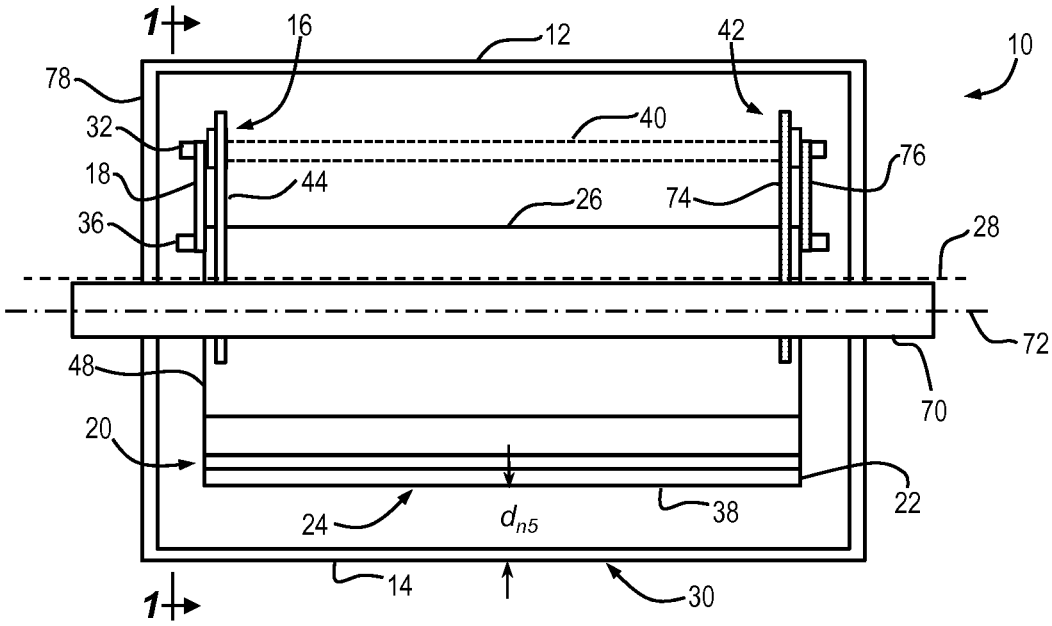
FIG. 2 is a schematic view of section 2-2 of the magnetic separator of FIG. 1.
Figure 4:
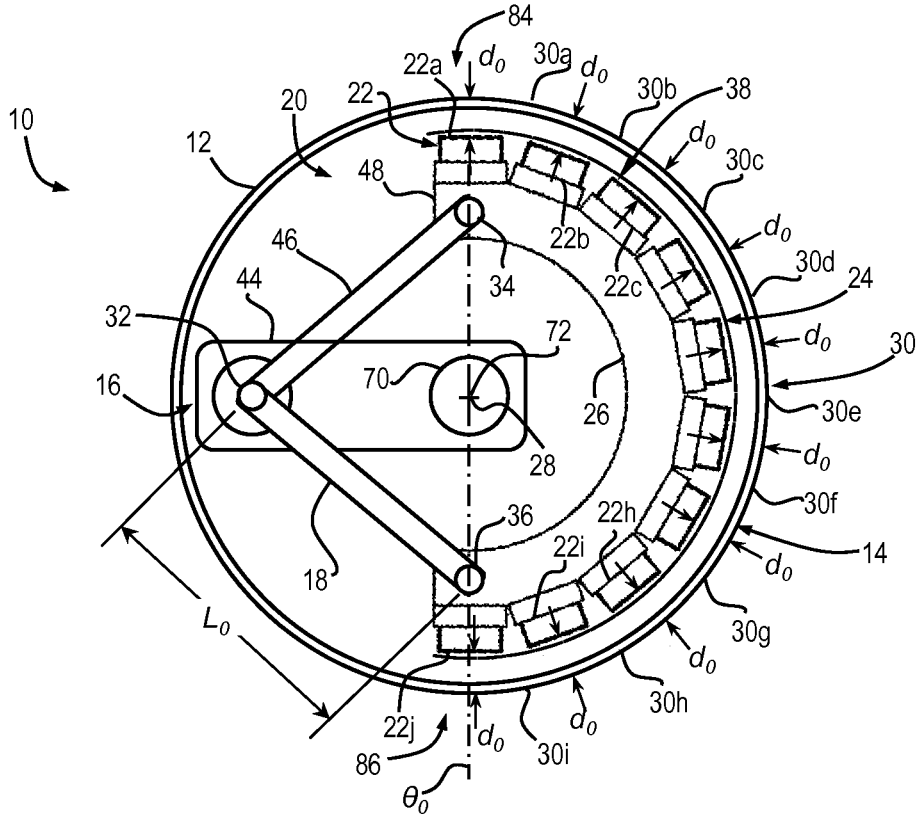
FIG. 4 is a schematic view of section 1-1 of the magnetic separator of FIG. 2 with the adjustable magnet array in the baseline position.
Figure 5:
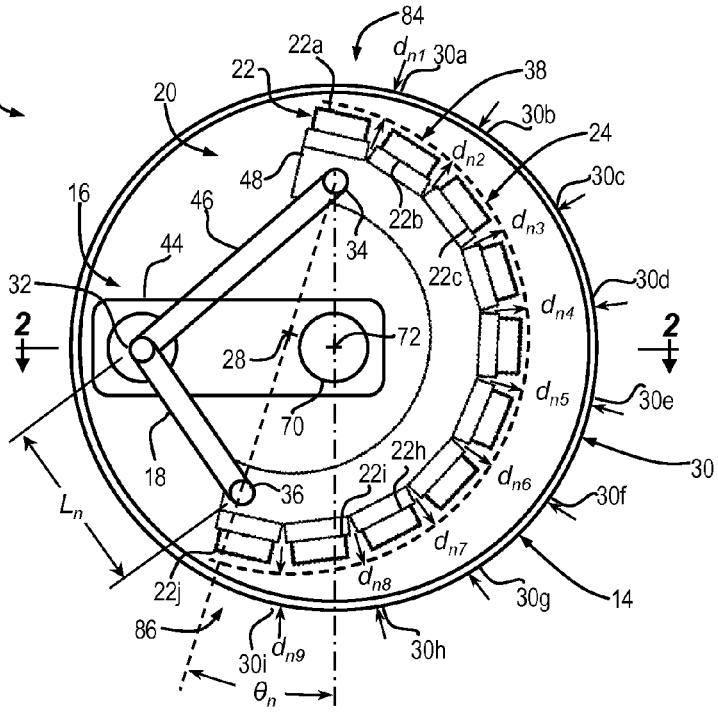
FIG. 5 is a schematic view of section 1-1 of the magnetic separator of FIG. 2 with the adjustable magnet array adjusted from the baseline position.

Referring to the drawings wherein like reference numbers represent like components throughout the several figures, there is shown in FIG. 1 a cross-sectional schematic view of an adjustable magnetic separation system generally indicated at 100 and including a magnetic separator generally indicated at 10. The magnetic separator 10 is configured to separate incoming material 50 into a non-magnetic portion 52 and a magnetic portion 54, and includes a magnetic separating member 12. In one example, the separation system 100 may be a magnetic drum separation system with the separating member 12 configured as a rotatable drum, and the separating member 12 may be referred to herein as a drum. The separating member 12 defines a separating surface 14 and houses an adjustable magnet assembly generally indicated at 20 and shown in additional detail in FIGS. 2-5. In FIG. 2, a cross-sectional schematic view of section 2-2 of the magnetic separator 10 and adjustable magnet 20 of FIG. 1 is provided. FIGS. 1, 2 and 5 shows the adjustable magnet 20 in an adjusted position relative to the separating surface 14, and FIG. 4 shows the adjustable magnet assembly 20 in a baseline position relative to the separating surface 14. The adjustable magnet assembly 20 may be referred to herein as the adjustable magnet, and includes a magnet array 48 configured to provide a magnetic field 24 measured at the magnet array surface 38, referred to herein as the array magnetic field. The array magnetic field 24 is characterized by a fixed magnetic intensity, e.g., field strength, defined by a plurality of permanent magnet elements 22 arranged to form the magnet array 48.

The magnet array 48 provides a magnetic field 30 measured at the separating surface 14, referred to herein as the effective magnetic field. The separating surface 14 is bounded by a leading end generally indicated at 84 and a trailing end generally indicated at 86, as shown in FIGS. 4 and 5, and includes the surface of the separating member 12 adjacent to the magnet array 48. The effective magnetic field 30 is characterized by a magnetic intensity, e.g., a magnetic field strength, defined by the magnet array 48 and relative position of the magnet array surface 38 and the separating surface 14, which may be defined by a distance between the magnet array surface 38 and the separating surface 14, such that the field strength of the effective magnetic field 30 is less than the field strength of the array magnetic field 24 at corresponding locations on the separating surface 14 and array surface 38. The adjustable magnet 20 may be positioned as shown in FIGS. 1, 2, and 5, such that the distance d between corresponding locations on the separating surface 14 and array surface 38 may vary, resulting in variation in the field strength of the effective magnetic field 30 as measured at the separating surface 14, and described in further detail herein.

In the non-limiting example shown in FIG. 1, the magnetic separation system 100 is configured as a magnetic drum separation system, including a magnetic drum separator 10. The magnetic separation system 100 includes a housing 60 containing the magnetic separator 10. The housing 60 defines an opening 56, which may be configured as an incoming material feed chute, through which incoming particulate material 50 may be provided to the magnetic separator 10 for processing, e.g., for magnetic separation into a separated magnetic portion 54 and a separated non-magnetic portion 52. The feed chute opening 56 may be adjustable, such that the size of the opening, and/or the flow rate and/or flow path of the incoming material 50 may be adjusted. In the example shown in FIG. 1, the feed chute opening 56 may be adjusted using a chute adjustment device 58 including a chute flap 62, where the position of the chute flap 62 may be varied to modify the chute opening 56. The housing 60 further defines second and third openings 66, 68, which may be configured as discharge chutes or define pathways for the removal of each of the separated material portions. In the example shown, the discharge chute 66 is configured for removal of the non-magnetic portion 52, and the discharge chute 68 is configured for removal of the magnetic portion 54.

In the example shown in FIGS. 1-2, the adjustable magnetic separator 10 is configured as a drum separator including a separating member 12 configured as a drum, and the adjustable magnet 20. The drum 12 is rotatably mounted on a support member 70 configured as a stationary shaft. The stationary shaft 70 is supported by and extends through the housing 60 and defines a longitudinal axis 72 of the shaft 70 and the drum 12. The drum 12 includes a cylindrical drum surface which defines the magnetic separating surface 14 of the magnetic separator 10. The drum 12 is enclosed on both ends by an end plate 78 which may include a hub portion to rotatably mount the drum 12 on the stationary shaft 70. A drive mechanism (not shown) may be operatively connected to the drum 12 and used to rotate the drum 12 with respect to the shaft 70 in a direction indicated by the arrow 82 and at a predetermined speed. The drive mechanism may be mounted on the stationary shaft 70. The end plate 78 may define an access (not shown) for accessing the adjustable magnet 20 including an adjustment mechanism 16. The access may be configured as an opening including a removable cover configured to close the opening during operation of the separator 10, or may be configured as a linkage providing a means to access the adjustment mechanism 16 and/or to adjust an adjustable element 18 of the adjustment mechanism 16.

The adjustable magnet 20 including the magnet array 48 and an adjustment mechanism generally indicated at 16 is housed in the drum 12. The magnet array 48 includes a plurality of permanent magnetic elements 22 configured to provide an array magnetic field 24 at the magnet surface 38 and an effective magnetic field 30 at the separating surface 14. The permanent magnetic elements 22 may be rare earth magnets containing neodymium and known as NIB or Neo magnets, or may be comprised of another type of permanent magnet such as a strontium ferrite magnet. In the example shown, the magnet array 48 includes a plurality of rare earth magnetic elements 22 made of a neodymium, iron, and boron (NIB) alloy. In the example shown in FIGS. 1-5, the magnet array 48 may include a mounting plate 26, which may be an arcuate plate, configured to retain the plurality of magnetic elements 22 arranged to define a longitudinally extending magnet surface 38. The arcuate magnet array 48 defines a longitudinal axis 28 and is configured to provide an arcuate magnetic field of approximately 180 degrees extending longitudinally relative the separating surface 14 as shown in FIG. 2, such that the incoming material 50 is fed on to the separating surface 14 at the leading end 84 of the separating surface 14 corresponding with the beginning of the effective magnetic field 30, and such that the effective magnetic field 30 terminates at the trailing end 86 of the separating surface 14, within the area over the opening 68 defining the discharge chute for magnetic material 54 separated during the magnetic separation process, where the beginning and end of the effective magnetic field 30 is relative to the direction of rotation 82 of the drum 12. The permanent magnetic elements 22 are of sufficient strength and arranged on the mounting plate 26 to provide an array magnetic field 24 having a predetermined intensity or strength measured at the magnet array surface 38 which is defined by the physical properties and arrangement of the magnetic elements 22 in the array 48. The examples provided herein are intended to be non-limiting, such that other arcuate configurations of the magnet array 48 may be used in the drum separator 10, which may range, for example, from 120 degrees to 180 degrees of arc.

The magnet array 48 is operatively attached to the stationary shaft 70 by the adjustment mechanism 16 such that the position of the magnet array 48 is adjustable relative to the separating surface 14. In the non-limiting example shown in FIGS. 1-3, the adjustment mechanism 16 includes a bracket 44. The bracket 44 may define an interface 80 (see FIG. 3) for attachment to the stationary shaft 70 to orient the adjustment mechanism 16 relative to the stationary shaft 70 and the shaft axis 72. The magnet array 48 is movably attached to the bracket 44 by an adjustable element 18 and an attachment element 46 via pivotable or rotatable attachment interfaces 32, 34, 36, referred to herein as pivots (see FIGS. 2-3). In the example shown, the adjustment element 18 is adjustable to define an adjustment reference $L_n$, where $L_n \leq L_0$, to adjust the position of the magnet array 48 relative to the separating surface 14, where the position of the magnet array 48 may be indicated by a position reference $\theta_n$, where $\theta_n \geq \theta_0$. The adjustment reference $L_n$ may be defined, in the example shown, as the length of the adjustable element 18 from pivot 32 to pivot 36.

In the example shown in FIGS. 1-5, the position reference $\theta_n$ may be the angle of rotation of the magnet array 48 from vertical (as shown on the page) about the pivot 34. In a baseline position shown in FIGS. 3 and 4, the adjustable element 18 may be adjusted to a baseline reference $L_0$ such that the magnet array 48 is positioned at $\theta_0$, e.g., at vertical, the axis 28 of the magnetic array 48 coincides with the shaft axis 72, and the magnet array surface 38 is generally concentric with and/or equidistant by a distance $d_0$ from the separating surface 14 to generate an effective magnetic field 30 which may be of constant magnetic intensity, as described in further detail herein. As shown in FIGS. 1 and 5, the magnet array 48 may be rotated away from vertical to a plurality of positions where the magnet array 48 is skewed to the separating surface 14 by adjusting the adjustable member 18 such that $L_n \leq L_0$, the axis 28 of the magnet array 48 is offset from the shaft axis 72 such that $\theta_n \geq \theta_0$, and the magnet array surface 38 is non-concentric with and rotated away from the separating surface 14 to generate an effective magnetic field 30 which may be of variable magnetic intensity, as described in further detail herein.

The adjustable element 18 is configured as a mechanically adjustable member. For example, the adjustable element 18 may be configured as or include a tie rod, push rod, jack screw, turnbuckle, locking hinge, a cam, a hinge or similar device which may be manipulated to continuously or discretely adjust the adjustment reference $L_n$ to a plurality of adjustment references ranging from a baseline reference $L_0$ to a limiting reference $L_{min}$, where $L_{min}$ may correspond to the adjustment limit of the adjustable element 18 or another limiting condition, such as the maximum position reference $\theta_{max}$ (not shown) to which the magnet array 48 may be rotated, for example, based on the configuration of the adjustable magnet assembly 20 including the adjustment mechanism 16, or an interference condition, such as interference of the rotated magnet array 48 with an interior surface of the drum 12 at rotations greater than $\theta_{max}$.

In a non-limiting example, the baseline position $L_0$ may correspond to the position of the array surface 38 when the adjustable element 18 is adjusted to position the magnet array 48 closest to the separating surface 14, and the limiting position $L_{min}$ may correspond to the position of the array surface 38 when the adjustable element 18 is adjusted to position the magnet array 48 furthest from the separating surface 14, within the configuration of the adjustable magnetic separator 10, at $\theta_{max}$. Other arrangements of the adjustable element 18 are possible, and the examples provided herein are intended to be non-limiting. For example, the adjustable element 18 may include two or more elements which are movable relative to each other to adjust the reference L. Examples include one or more slotted plates or a rod and tube arrangement with a locking key, bolt, clip, clamp, etc. configured to fix the relative position of the plates or rod and tube to establish the reference L.

The attachment element 46 may be configured as a bracket pivotally attached at 32, 34. In one example, the attachment element 46 and the bracket 44 may be defined by a single element, such as a plate fixedly attached at the interface 80 to the stationary shaft 70 and pivotally attached to the magnet array 48 at 34. In another example, the attachment element 46 may be configured as an adjustable element similar to the adjustable element 18, such that the position of the magnet array 48 relative to the separating surface 14 may be modified by adjusted one or both of the elements 18, 46.

As shown in FIG. 2, the adjustable magnet 20 may include an attachment mechanism generally indicated at 42 including additional elements to affix, support and/or stabilize the position of the magnet array 48 relative to the shaft 70 at the end of the magnet array opposing the adjustment mechanism 16. The optional attachment mechanism 42 may include a support bracket 74 (see FIG. 2) and one or more attachment elements to affix the magnet array 48 relative to the shaft 70 and/or the adjustment mechanism 16. In one example, the support bracket 74 and an attachment element (not shown), which may be configured similarly to the attachment element 46, may be arranged to affix and pivotally support the end of the magnet array 48 opposing the adjustment mechanism 16, to stabilize the longitudinal position of the magnet array 48. An optional attachment element 40 may operatively attach brackets 44, 74 to support the magnet array 48. In another example, an attachment element 76 may be configured to pivotally and adjustably attach the magnet array 48 to the optional attachment bracket 74. The attachment element 76 may be an adjustable element configured similarly to the adjustable element 18, and may be adjustable to establish the reference $L_n$ at the other end of the magnet array 48 opposing the adjustment mechanism 16. The attachment element 76 may be configured as a follower element such that as the adjustable element 18 is adjusted to modify the reference $L_n$, the attachment element 76 moves or adjusts in a corresponding fashion with the adjustable element 18, to establish the same reference $L_n$ at the end of the magnet array 48 opposing the adjustment mechanism 16.

Referring again to FIG. 1, the incoming material 50 may be gravity fed into the separation system 100 through the feed chute 56 and directed onto the leading end 84 of the separating surface 14 of the rotating drum 12 corresponding to the beginning of the effective magnetic field 30 defined by the configuration and position of the magnet array 38. The chute adjustment device 58 may be configured to modify the flow path of the incoming material 50 onto the separating surface 14 to adjust the flow path and/or rate of flow relative to the characteristics of the incoming material 50, including, for example, the particle size range of the material being separated.

The incoming material 50 may be an aggregate or particulate material containing particles having varying magnetic susceptibilities. For example, the incoming material 50 may be a slag, slag-type, or slag-containing material which may be waste material from the steel and iron producing industry, and may include slag generated in a blast furnace, a converter, a basic oxygen furnace (BOF), or an electric furnace, and/or one or more of the types of slag commonly referred to as blast furnace slag, kish slag, c-scrap slag, desulfurization slag, and/or a combination of these. The slag material 50 may be provided to the magnetic separation system 100 by any suitable material handling means (not shown) for handling slag materials, including, for example, a feeding belt conveyor, screw conveyor, bin, hopper, etc. The slag material 50 includes ferrous and non-ferrous particles having differing magnetic susceptibilities. The ferrous particles may have varying iron content such that a ferrous particle with a relatively higher iron content will have a different magnetic susceptibility than a ferrous particle with lower iron content.

Magnetic particles 54 in the incoming material 50, e.g., particles having sufficient magnetic susceptibility to be attracted by the effective magnetic field 30 provided at the separating surface 14 by the magnet array 48, are attracted by the effective magnetic field 30 and magnetically adhere to the separating surface 14 as the drum 12 is rotated in the direction of arrow 82 until the effective magnetic field 30 terminates at the trailing end 86, at which point the magnetic particles 54 disengage from and/or fall away from the separating surface 14 and exit the magnetic separation system 100 through the magnetic discharge chute 68. The magnetic particles 54 discharged through the chute 68 comprise the magnetic portion 54 separated from the incoming material 50. Non-magnetic particles 52 in the incoming material 50, e.g., particles having insufficient magnetic susceptibility to be attracted by the effective magnetic field 30, are not attracted to the separating surface 14 of the drum 12, and fall freely away from the separating surface 14 to drop through the housing 60 to exit the magnetic separation system 100 through the non-magnetic discharge chute 66. The non-magnetic particles 52 discharged through the chute 66 comprise the non-magnetic portion 52 separated from the incoming material 50.

As used herein, a "magnetic portion" is comprised of "magnetic particles" 54 which are the portion of particles of the incoming particles 50 which have an iron content and/or magnetic susceptibility sufficient to be magnetically attracted and/or affected by the effective magnetic field 30 of the magnetic separator 10 such that they adhere to the separating surface 14 or are sufficiently diverted from their falling trajectory by attraction to the effective magnetic field 30 to be collected as a magnetic portion 54. As used herein, a "non-magnetic portion" is comprised of "non-magnetic particles" 52 which are the portion of particles of the incoming particles 50 having less than the iron content and/or magnetic susceptibility sufficient to be affected by the effective magnetic field 30 of the magnetic separator 10 such that they maintain a falling trajectory which is unaffected and/or minimally influenced by the effective magnetic field 30 of the separator 10 and as such fall freely away from the separating surface 14 to be collected as a non-magnetic portion 52. It would be understood that the terms "magnetic portion" and "non-magnetic portion" are relative to the strength or intensity of the effective magnetic field 30 through which the particles 50 are processed.

A relatively higher intensity effective magnetic field 30 may be used to attract particles with lower magnetic susceptibility including particles which may have relatively moderate or lower iron content. A relatively lower intensity effective magnetic field 30 may be used to attract particles with high magnetic susceptibility including particles which may have relatively higher iron content. In the examples shown in FIG. 1-5, the intensity of the effective magnetic field 30 is relatively higher when the magnet array 48 is in the baseline position shown in FIG. 4, and the intensity of the effective magnetic field 30 is relatively lower when the magnet array is skewed away from the separating surface 14 in an adjusted position, such as the adjusted position shown in FIG. 5, as described in further detail herein. The position of the magnet array 48 may be varied to provide an effective magnetic field 30 of a predetermined intensity to magnetically separate a magnetic portion having a magnetic susceptibility and/or iron content corresponding to the predetermined intensity.

A diverter 64 may be provided to assist removal of the separated portions 52, 54 by providing a division between the chutes 66, 68 which may extend into the discharge stream of the separated portions, to facilitate discharge of the magnetic portion 54 through the chute 68 and discharge of the non-magnetic portion 52 through the chute 66. One or more scrapers or wiper bars (not shown) may be used to remove or dislodge magnetic particles 54 from the separating surface 14 for discharge through the magnetic chute 68.

Figure 3:
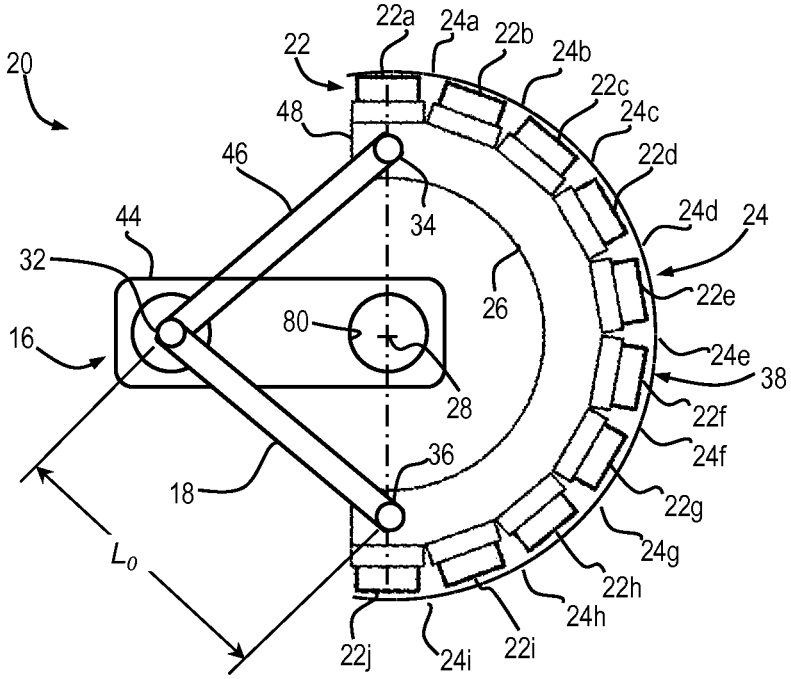
FIG. 3 is a schematic end view of the adjustable magnet of FIG. 1, in the baseline position.

FIG. 3 shows the adjustable magnet 20 in additional detail. The magnet array 48 includes a plurality of permanent magnet elements 22 in fixed position relative to each other, wherein the plurality of permanent magnet elements 22 generates the array magnetic field 24. The plurality of magnet elements 22*a* . . . 22*j* are arranged such that each of the magnet elements 22*a* . . . 22*j* is adjacent to another of the magnet elements 22*a* . . . 22*j*, and each pair of adjacent magnet elements generates a fixed magnetic field 24*n* therebetween at the surface 38 of the magnet array 48, where a fixed magnetic field 24*n* in the example shown refers to one of the fixed magnetic fields 24*a* . . . 24*i*. For example, the pair of adjacent magnet elements 22*a*, 22*b* generates a fixed magnetic field 24*a*, the pair of adjacent magnet elements 22*b*, 22*c* generates a fixed magnetic field 24*b*, and so on. The array magnetic field 24 is defined by the plurality of fixed magnetic fields 24*a* . . . 24*i*, such that the array magnetic field 24, which is measured at the surface 38 of the magnet array 48, has a fixed magnetic strength.

In the example shown in FIGS. 1-5, each of the magnet elements 22*a* . . . 22*j* is circumadjacent to another of the magnet elements 22*a* . . . 22*j* to form the arcuate magnet array 48. Each of the circumadjacent pairs of magnet elements defines a fixed magnetic field which projects radially from the array surface 38 relative to the array axis 28. For example, the magnet element pair 22*g*, 22*h* generates a fixed magnetic field 24*g* which projects radially from the array surface 38. The intensity of the fixed magnetic field 24*g* is defined by the relative position of the adjacent magnet elements 22*g*, 22*h* to each other, and by the magnetic strength of each of the magnet elements 22*g*, 22*h*. It would be understood that the number of magnet elements 22 may vary according to the configuration of the magnet array 48, and the example shown in FIGS. 1-5 is not intended to be limiting of the shape, size, arrangement or number of magnet elements 22 comprising the magnet array 48.

Referring now to FIGS. 4 and 5, FIG. 4 shows the adjustable magnet 20 positioned in the drum 12 at a baseline position corresponding to $L_0$, $\theta_0$, and FIG. 5 shows the adjustable magnet 20 positioned in the drum 12 at an adjusted position corresponding to $L_n$, $\theta_n$. As described previously, the effective magnetic field 30 measured at the separating surface 14 is defined by the fixed array magnetic field 24 and the distance $d_n$ between the array surface 38 and the separating surface 14. It would be understood that the effective magnetic field 30 is at its greatest intensity when the array surface 38 is closest to the separating surface 14, e.g., when the distance $d_n$ is minimized, and that the intensity of the effective magnetic field 30 decreases as the distance $d_n$ increases, e.g., as the array surface 30 is moved away from the separating surface 14. In the present example, the distance $d_n$ increases as the magnet array 48 is moved from the baseline position of FIG. 4 to an adjusted position, such as the adjusted position shown in FIG. 5, and the intensity of the effective magnetic field 30 when the magnet array 48 is in the baseline position of FIG. 4 is greater than the intensity of the effective magnetic field 30 when the magnet array 48 is in the adjusted position of FIG. 5. Because the array surface 38 is equidistant from the separating surface 14 in the baseline position shown in FIG. 4, being separated by a radial gap of constant width $d_0$, the intensity of the effective magnetic field 30 in FIG. 4 is in constant proportion, e.g., constant relative to the fixed intensity of the array magnetic field 24. Because the array surface 38 is skewed from the separating surface 14 in the adjusted position shown in FIG. 5, being separated by a radial gap of variable width ranging from $d_{n1} \ldots d_{n9}$ when the array surface 38 is at $\theta_n$, the intensity of the effective magnetic field 30 in FIG. 5 is variable relative to the fixed intensity of the array magnetic field 24, e.g., the intensity of the effective magnetic field 30 will be variable at different locations on the separating surface 14, in variable proportion to the fixed intensity of the array magnetic field 24 according to the distance $d_{n1} \ldots d_{n9}$ at each of the different locations.

The magnet array 48 is shown in FIG. 4 adjusted to the baseline position with the adjustable element 18 adjusted to the baseline reference $L_0$ and the magnet array 48 positioned at $\theta_0$ (vertical as shown on the page) such that the axis 28 of the magnetic array 48 coincides with the shaft axis 72. At the baseline position, the magnet array surface 38 is generally concentric with and/or equidistant from the separating surface 14 as shown in FIG. 4 by the same radial distance $d_0$ between each of the plurality of magnet elements 22 and the separating surface 14. At the baseline position shown in FIG. 4, with the magnet array 48 substantially concentric to and equidistant from the separating surface 14, the effective magnetic field 30 is defined by the array magnetic field 24 and the distance $d_0$, and the strength of the effective magnetic field 30 is directly proportional to the strength of the fixed array magnetic field 24 at a corresponding radial position.

In a non-limiting example, each of the permanent magnet elements 22*a* . . . 22*j* may be configured with substantially the same permanent magnet intensity, such that each of the fixed magnetic fields 24*a* . . . 24*i* have substantially the same fixed magnetic intensity, and the array magnetic field 24 defined by the plurality of fixed magnetic fields 24*a* . . . 24*i* is characterized by a substantially constant intensity across the array surface 38. The effective magnetic field 30, in this example and with the magnet array 48 in the baseline position shown in FIG. 4, would be characterized by an effective magnetic intensity which is substantially constant across the separating surface 14 adjacent to array surface 38, e.g., the effective magnetic fields 30*a* . . . 30*i* each have substantially the same effective magnetic intensity, which is proportional to the fixed intensity of the array magnetic field 24 and the constant radial distance $d_0$ between the array surface 38 and the separating surface 14. Referring now to FIGS. 1 and 4, it would be understood that with the magnet array 48 in the baseline position shown in FIG. 4, e.g., generally concentric to the separating surface 14 and configured to provide an array magnetic field 24 of constant intensity generating a corresponding effective magnetic field 30 of constant intensity at the separating surface 14, the adjustable magnetic separation system 100 of FIG. 1 would be substantially operable as a conventional fixed (non-adjustable) permanent magnetic separator. In this configuration, particles 54 in the incoming material 50 fed into the separation system 100 which have an iron content and/or magnetic susceptibility sufficient to be magnetically attracted by the effective magnetic field 30 corresponding to the magnet array 48 in the baseline position shown in FIG. 4 (e.g., corresponding to $L_0$ and $\theta_0$ and defined by the constant distance $d_0$) are collected as a magnetic portion 54.

Referring again to FIGS. 4 and 5, the effective magnetic field 30 is defined by the plurality of effective magnetic fields 30*a* . . . 30*i* projecting radially from the separating surface 14. The intensity of each of the effective magnetic fields 30*n*, where 30*n* refers to one of the effective magnetic fields 30*a* . . . 30*i*, is determined by the respective corresponding fixed magnetic field 24*n*, and the distance $d_n$ between the array surface 38 and the separating surface 14 corresponding to the fixed magnetic field 24*n*. Because the distance $d_n$ can be varied by adjusting the position of the magnet array 48, the intensity of the effective magnetic field 30*n* will vary with the distance $d_n$.

For example, the effective magnetic field 30*b* is determined by the fixed magnetic field 24*b* and the radial distance $d_{n2}$, where the fixed magnetic field 24*b* is generated by the adjacent pair of magnet elements 22*b*, 22*c*, and the distance $d_{n2}$ is the distance between the array surface 38 defined by the adjacent pair of magnet elements 22*b*, 22*c* and the separating surface 14. In FIG. 4, with the magnet array 48 at the baseline position $L_0$, $\theta_0$ and substantially concentric with the separating surface 14, the intensity of the effective magnetic field 30*b* is determined by the fixed magnetic field 24*b* and the radial distance $d_0$. In FIG. 5, with the magnet array 48 at the adjusted position corresponding to $L_n<L_0$, $\theta_n>\theta_0$ such that the magnet array 48 is skewed away from the separating surface 14, the intensity of the effective magnetic field 30*b* is determined by the fixed magnetic field 24*b* and the radial distance $d_{n2}>d_0$. Because $d_{n2}>d_0$, and the intensity of the effective magnetic field 30*b* is inversely proportional to the distance d between the magnet array 48 and the separating surface 14, it would be understood that the intensity of the effective magnetic field 30*b* is greater with the magnet array in the baseline position shown in FIG. 4 than in the adjusted position shown in FIG. 5.

Referring again to the non-limiting example where each of the permanent magnet elements 22*a* . . . 22*j* may be configured with substantially the same permanent magnet intensity, such that each of the fixed magnetic fields 24*a* . . . 24*i* have substantially the same fixed magnetic intensity and the array magnetic field 24 is characterized by a substantially constant intensity across the array surface 38, the magnet array 48 may be adjusted to the adjusted position shown in FIG. 5, where the array surface 38 is skewed or non-concentric to the separating surface 14, e.g., the magnet array 48 is positioned with $L_n<L_0$ and $\theta_n>\theta_0$. The effective magnetic field 30, in this example and with the magnet array 48 in the adjusted position $L_n<L_0$, $\theta_n>\theta_0$ shown in FIG. 5, would be characterized by an effective magnetic intensity which is variable across the separating surface 14 adjacent to array surface 38, e.g., each of the effective magnetic fields 30*a* . . . 30*i* defining the effective magnetic field 30 in FIG. 5 would be characterized by a different effective magnetic intensity inversely proportional to the respective radial distance $d_{n1}$ . . . $d_{n9}$ between the array surface 38 and the separating surface 14. For example, given $d_{n1}<d_{n2}<d_{n3}<d_{n4}<d_{n5}>d_{n6}>d_{n7}>d_{n8}>d_{n9}$ as shown in FIG. 5, the intensity of the effective magnetic field 30*a* would be greater than the intensity of the effective magnetic field 30*b* since $d_{n1}<d_{n2}$, the intensity of the effective magnetic field 30*c* would be greater than the intensity of the effective magnetic field 30*d* since $d_{n3}<d_{n4}$, the intensity of the effective magnetic field 30*e* would be less than the intensity of the effective magnetic field 30*f* since $d_{n5}>d_6$, the intensity of the effective magnetic field 30*f* would be less than the intensity of the effective magnetic field 30*g* since $d_{n6}>d_{n7}$, etc.

The resulting effective magnetic field 30 shown in FIG. 5 will vary in intensity across the separating surface 14, having the greatest or highest intensity at the leading and trailing ends 84, 86, where the array surface 38 is closest to the separating surface 14, and having the weakest or lowest intensity in the central portion of the separating surface 14 defined by the effective magnetic field 30*e*. In this configuration, particles 54 in the incoming material 50 fed into the separation system 100 which have an iron content and/or magnetic susceptibility sufficient to be magnetically attracted by the effective magnetic field 30 corresponding to the magnet array 48 in the adjusted position shown in FIG. 5 (e.g., corresponding to $L_n$, $\theta_n$ and varying with the distance $d_{n1}$ . . . $d_{n9}$) are collected as a magnetic portion 54. The intensity of the effective magnetic field 30 when the magnet array 48 is in a skewed or adjusted position varies such that the intensity of the effective magnetic field 30 is relatively stronger at the leading end of the effective magnetic field 30, e.g., where defined by the effective magnetic fields 30*a* . . . 30*c*, e.g., where the array surface 38 is relatively closer to the separating surface 14 at $d_{n1}$ . . . $d_{n3}$, and the effective magnetic field 30 is relatively weaker where defined by the effective magnetic fields 30*d* . . . 30*f*, e.g., where the array surface 38 is relatively farther from the separating surface 14 at $d_{n4}$ . . . $d_{n6}$. As such, the incoming material 50 is fed into a higher intensity effective magnetic fields 30*a* . . . 30*c* which may initially attract some particles having an iron content or magnetic susceptibility attractive to the higher intensity effective magnetic fields 30*a* . . . 30*c*, but of insufficient iron content or magnetic susceptibility to remain attracted to the relatively weaker effective magnetic fields 30*d* . . . 30*f*, such that these particles having insufficient iron content may fall away from the separating surface 14 adjacent to the weaker effective magnetic fields 30*d* . . . 30*f* and may be separated as non-magnetic particles 52. The remaining particles magnetically adhering to the separating surface 14, e.g., those with sufficient iron content or magnetic susceptibility to be attracted to the relatively weaker effective magnetic fields 30*d* . . . 30*f*, are retained as magnetic particles 54 by the separating surface 14 until they separate from the trailing end 86 of the effective magnetic field 30 or are separated from the separating surface 14 by other means, for example, by a drum scraper (not shown) positioned to separate the magnetic particles 54 from the drum 12 near the trailing end 86 for removal through the chute 68.

The variability of the effective magnetic field 30 when the magnet array 48 is in a skewed, e.g., non-concentric or adjusted position may increase the efficiency of magnetic separation by initial attracting at the leading end 84 of the separating surface 14 particles having a minimum iron content lower than the predetermined, e.g., desired iron content, to ensure attraction and adherence of particles having the predetermined iron content by using the relatively stronger effective magnetic fields 30*a* . . . 30*c* to overcome falling inertia of the particles having the predetermined iron content.

As the drum 12 rotates in the direction 82 and the magnetically adhering particles are carried into the relatively weaker effective magnetic fields 30*d* . . . 30*f*, those particles having an iron content lower than the predetermined iron content will no longer be magnetically attracted to the relatively weaker effective magnetic fields 30*d* . . . 30*f*, and will separate from the separating surface 14 of the drum 12 to fall away as non-magnetic particles 52 through the chute 66. Efficiency may be gained by more effectively collecting the particles 54 having the predetermined minimum iron content at the leading end 84 of the separating surface 14, which may otherwise have been carried by inertia to the non-magnetic discharge 66.

As the drum 12 continues to rotate in the direction 82, the magnetic particles 54 adhering to the separating surface 14 are subjected to increasingly strong effective magnetic fields 30*g* . . . 30*i*, which may effectively resist any separation inertia the particles 54 may be subjected to by rotation of the drum 12 by increasing the attractive force retaining the magnetic particles 54 to the separating surface 14 until they are disengaged at the trailing end 86 for discharge through the chute 68.

The position of the magnet array 48 may be adjusted to accurately provide the predetermined variable effective magnetic field 30 required for separation of magnetic particles 54 having the predetermined minimum iron content or magnetic susceptibility, thus providing increase flexibility as contrasted to a fixed position permanent magnet separation system. The ability to adjust the position of the magnet array 48 to one or more adjusted positions allows use of the same magnetic separation system 100 to separate incoming material into portions having different iron contents through repeated separation of incoming material 50 and separated portions 52, 54 thereof through the same magnetic separation system 100, by adjusting the position of the magnet array 48 for each separation sequence and predetermined iron content specific to that separation sequence.

Figure 6:
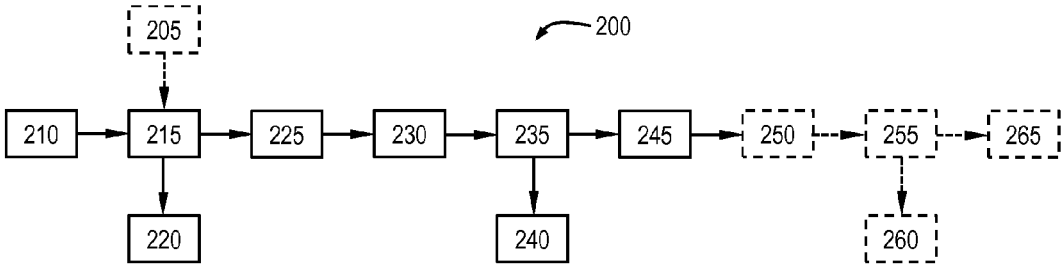
FIG. 6 is a schematic illustration of a first example process to magnetically separate an aggregate material using the magnetic separator of FIG. 1.

Referring now to the example process illustrated in FIG. 6 and generally indicated at 200, at a first adjustment step 210, an adjustable magnetic separation system, which may be, for example, the adjustable magnetic drum separation system 100 of FIG. 1, is provided with the adjustable magnet assembly 20 in a first position corresponding to the adjustable element 18 adjusted to an adjustment reference $L_X$ such that the magnet array 48 is positioned to a position reference $\theta_X$, e.g., the magnet array 48 is in a first position $L_X$, $\theta_X$. In the first position $L_X$, $\theta_X$, the magnet array 48 is positioned to provide a first effective magnetic field 30 characterized by a relatively weaker magnetic intensity. In the first position, $L_{min} \leq L_X < L_0$, $\theta_{max} \geq \theta_X > \theta_0$, and the distance between the array surface 38 and the separating surface 14 varies from $d_{X1} \ldots d_{X9}$, where $d_{X1} > d_0$, $d_{X2} > d_0$ etc. In a non-limiting example, the first position $L_X$, $\theta_X$ may be the position $L_{min}$, $\theta_{max}$, where the adjustable member 18 is adjusted to an adjustment reference $L_{min}$ such that the magnet array 48 is positioned at a position reference $\theta_{max}$ and the array surface 38 is at its farthest adjustable distance from the separating surface 14 of the drum 12. In the position $L_{min}$, $\theta_{max}$, the magnet array 40 provides an effective magnetic field 30 which is characterized by a relatively weaker magnetic intensity than an effective magnetic field 30 provided by the magnet array 48 in a position where $\theta_n < \theta_{max}$ and $L_n > L_{min}$, such that the first effective magnetic field 30 may be described as an effective magnetic field 30 of relatively weak magnetic intensity. In one example, the relatively weaker baseline effective magnetic field 30 of the magnetic separator 10 adjusted as in step 210 may define the weakest effective magnetic field 30 which may be generated by the adjustable magnet assembly 20 relative to the separating surface 14 and the configuration of the adjustment mechanism 16.

In the example shown, the adjustable magnet assembly 20 and the magnetic separator 10 are configured at step 210 such that in the first position $L_X$, $\theta_X$, the first effective magnetic field 30 is configured to attract particles having a minimum iron content of X % iron by weight, such that the magnetic portion 54 separated by the magnetic separator 10 with the magnet array 48 in the first position $L_X$, $\theta_X$ comprises particles having a minimum iron content of X %. The minimum iron content of X % may be a predetermined iron content such that the first magnetic portion 54 having an iron content of at least X % may be characterized as a high iron content product, which may be referred to herein as high iron material, a finished high iron product, or a primary product. The first non-magnetic portion 52 separated by the magnetic separator 10 with the magnet array 48 in the first position $L_X$, $\theta_X$ comprises particles having an iron content of less than X %, such that the first non-magnetic portion may be characterized as including iron rich product. In a non-limiting example, X % may be 85% or greater iron content by weight. In one example, X % is approximately 88%. In another example, material having an iron content of greater than X % may have sufficient iron content such that the material is suitable for use as charge in an iron or steel refining operation.

At a first separation step 215, incoming material 50 including particles of varying iron content and/or magnetic susceptibility, which may be, for example, an aggregate material comprising slag, is fed into the separation system 100 with the magnet array 48 in the first position $L_X$, $\theta_X$, and is magnetically separated by the magnetic separator 10 as previously described herein into a first magnetic portion 54 having an iron content of at least X %, and a first non-magnetic portion 52 having an iron content of less than X %, where the first magnetic portion 54 is characterized as a finished high iron product or a primary product, and the first non-magnetic portion 52 is characterized as including iron rich material.

At a collection step 220, the first magnetic portion 54 is collected as a finished high iron product. The finished high iron product may be suitable, for example, as charge in an iron or steel refining or processing operation, such as a blast furnace, a sintering plant, an electric arc furnace, foundry, or ferro-alloy production process. Consumers of the finished iron rich product may include consumers of conventional pig iron and scrap. At a collection step 225, the first non-magnetic portion 52, which is includes iron rich product having an iron content of less than X % by weight, may be collected as a secondary product or may optionally be further separated, for example, according to the process 200.

At a second adjustment step 230, an adjustable magnetic separation system 100 is provided with the adjustable magnet assembly 20 in a second position $L_Y$, $\theta_Y$. The separation system 100 may be the separation system 100 used in steps 210 through 225 with the adjustable magnet assembly 20 adjusted to the second position $L_Y$, $\theta_Y$, such that step 210 through step 245 may be completed using a single separation system 100. Alternatively, the adjustable magnet assembly 20 may be included in another separation system 100 and adjusted to the second position $L_Y$, θy. In the second position $L_Y$, $\theta_Y$ the magnet array 48 is positioned such that the magnet array 48 is non-concentric or skewed to the separating surface 14, as shown in FIG. 4, to generate a second effective magnetic field 30. In the second position $L_Y$, $\theta_Y$, the adjustable member 18 is adjusted to an adjustment reference $L_Y$ where $L_X < L_Y < L_0$, the magnet array 48 is positioned at a position reference $\theta_Y$ where $\theta_X > \theta_Y > \theta_0$, and the array surface 38 is skewed to the separating surface 14 of the drum 12 such that the distance between the array surface 38 and the separating surface 14 varies from $d_{Y1} \ldots d_{Y9}$, where $d_{Y1}>d_{Y1}$, $d_{Y2}>d_{Y2}$, etc. In the second position $L_Y$, $\theta_Y$, the magnet array 40 generates a second effective magnetic field 30 which is characterized by a relatively stronger magnetic intensity than the first effective magnetic field 30 provided by the magnet array 48 in the first position $L_X$, $\theta_X$ and is further characterized by a relatively weaker magnetic intensity than an effective magnetic field 30 provided by the magnet array 48 in the baseline position $L_0$, $\theta_0$, such that the second effective magnetic field 30 may be described as an effective magnetic field 30 of intermediate magnetic intensity.

In the example shown, the adjustable magnet assembly 20 and the magnetic separator 10 is configured such that in the second position $L_Y$, $\theta_Y$, the second effective magnetic field 30 is configured to attract particles having a minimum iron content of Y % iron by weight, such that the magnetic portion 54 separated by the magnetic separator 10 with the magnet array 48 adjusted at step 230 to the second position $L_Y$, $\theta_Y$ comprises particles having a minimum iron content of Y %. The minimum iron content of Y % may be a predetermined iron content such that the second magnetic portion 54 having an iron content of at least Y % may be characterized as a medium iron content product, which may be referred to herein as medium iron material or a finished medium iron product. The second non-magnetic portion 52 separated by the magnetic separator 10 with the magnet array 48 in the second position $L_Y$, $\theta_Y$ comprises particles having an iron content of less than Y %, such that the second non-magnetic portion may be characterized as a secondary product. In a non-limiting example, Y % may be 55% or greater iron content by weight. In one example, Y % is approximately 60%. In another example, the second magnetic portion 54 may have an iron content of greater than Y % and less than X % such that the material is characterized by a specific gravity in a predetermined range rendering it suitable for use as counterweight filler material.

At a second separation step 235, the first non-magnetic portion 52 separated at step 215 and collected as an iron rich material at step 225 is fed into the separation system 100 with the magnet array 48 in the second position $L_Y$, $\theta_Y$, and magnetically separated by the magnetic separator 10 as previously described herein into a second magnetic portion 54 having an iron content of at least Y % and less than X %, and a second non-magnetic portion 52 having an iron content of less than Y %, where the second magnetic portion 54 is characterized as a medium iron product, and the second non-magnetic portion 52 is characterized as a secondary product.

At a collection step 240, the second magnetic portion 54 is collected as a finished medium iron product. The finished medium iron product may be suitable, for example, for use in one or more specialty applications such as counterweight material or applications in the coal processing industry. At a collection step 245, the second non-magnetic portion 52 having an iron content of less than Y % by weight may be collected as a secondary product including a low-to-medium iron product. In one example, the second non-magnetic portion 52, e.g., the secondary product may be further processed to provide particles of increased iron content, by grinding or other processing intended to liberate particles of increased iron content, prior to further processing the material using magnetic separation. Optionally the second non-magnetic portion 52 may be further separated, for example, according to the process 200.

Still referring to FIG. 6, the process 200 may optionally continue with steps 250 through 260. At a third adjustment step 250, an adjustable magnetic separation system 100 is provided with the adjustable magnet assembly 20 in a third position $L_W$, $\theta_W$. The separation system 100 may be the separation system 100 used in steps 210 through 245 with the adjustable magnet assembly 20 adjusted to the third position $L_W$, $\theta_W$, such that step 210 through step 245 may be completed using a single separation system 100. Alternatively, the adjustable magnet assembly 20 may be included in another separation system 100 and adjusted to the third position $L_W$, $\theta_W$. In the third position $L_W$, $\theta_W$ the magnet array 48 is positioned to provide a third effective magnetic field 30 characterized by a relatively stronger magnetic intensity. In the third position, $L_Y<L_W\leq L_0$, $\theta_Y>\theta_W\geq\theta_0$, and the distance between the array surface 38 and the separating surface 14 varies from $d_{W1} \ldots d_{W9}$, where $d_{Y1}<d_{W1}\leq d_0$, $d_{Y2}<d_{W2}\leq d_0$ etc. In a non-limiting example, the third position $L_W$, $\theta_W$ may be the baseline position $L_0$, $\theta_0$ shown in FIG. 4, where the adjustable member 18 is adjusted to an adjustment reference $L_0$ such that the magnet array 48 is positioned at a position reference $\theta_0$ and the array surface 38 is substantially concentric to the separating surface 14 of the drum 12 and positioned a substantially constant distance $d_0$ from the separating surface 14, e.g., each of $d_{W1} \ldots d_{W9}$ are substantially equal to $d_0$. In the baseline position $L_0$, $\theta_0$, the magnet array 48 provides a baseline effective magnetic field 30 which is characterized by a relatively stronger magnetic intensity than an effective magnetic field 30 provided by the magnet array 48 in a position where $\theta_n>\theta_0$ and $L_n<L_0$, such that the third effective magnetic field 30 may be described as an effective magnetic field 30 of relatively strong magnetic intensity. In one example, the baseline effective magnetic field 30 may be defined by a constant magnetic intensity proportional to the intensity of the array magnetic field 24 and the distance $d_0$. In one example, the relatively stronger baseline effective magnetic field 30 may define the strongest effective magnetic field 30 which may be generated by the adjustable magnet assembly 20 relative to the separating surface 14 and the configuration of the adjustment mechanism 16.

In the example shown, the adjustable magnet assembly 20 and the magnetic separator 10 is configured such that in the third position $L_W$, $\theta_W$, a third effective magnetic field 30 is generated which is configured to attract particles from the second non-magnetic portion having a minimum iron content of W % iron by weight, such that a third magnetic portion 54 separated by the magnetic separator 10 with the magnet array 48 in the third position $L_W$, $\theta_W$ comprises particles having a minimum iron content of W % and an iron content of less than Y %. The minimum iron content of W % may be a predetermined iron content such that the third magnetic portion 54 having an iron content of at least W % and less than W % may be characterized as a low to medium iron rich product. The third non-magnetic portion 52 separated by the magnetic separator 10 with the magnet array 48 in the third position $L_W$, $\theta_W$ comprises particles having an iron content of less than W % which may be a relatively low iron content such that the third non-magnetic portion 52 is characterized as a low iron material or finished low iron product. In a non-limiting example, W % may be 30% or less iron content by weight. In one example, W % is approximately 27%. In another example, material having an iron content of less than W % may have insufficient iron content such that the material is not suitable for use as charge in an iron or steel refining operation.

At a third separation step 255, the second non-magnetic portion 52 separated at step 235 and collected as a secondary material at step 245 is fed into the separation system 100 with the magnet array 48 in the third position $L_W$, $\theta_W$, and magnetically separated by the magnetic separator 10 as previously described herein into a third magnetic portion 54 having an iron content of at least W % and less than Y %, and a third non-magnetic portion 52 having an iron content of less than W %, where the third magnetic portion 54 is characterized as a low-to-medium iron product, and the third non-magnetic portion 52 may be characterized as a finished low iron product. The finished low iron product may be suitable for use in applications requiring low ferrous content such as in the cement industry or for clinker manufacturing, and/or for use in one or more specialty applications such as blasting media, industrial absorbent, acid mine drainage neutralizer, acid mine land recovery, road traction media, and salt additive. Other applications for finished low iron product may include constituent material for cement and hot mix asphalt, use as a lime replacement, iron additive or skid resistance additive, agricultural lime replacement, or in landfills as groundcover material or roadway material.

At a collection step 260, the third magnetic portion 54 is collected as a low-to-medium iron product may be further processed to provide particles of increased iron content, by grinding or other processing intended to liberate particles of increased iron content, prior to further processing the material using magnetic separation. At a collection step 265, the third non-magnetic portion 52 having an iron content of less than W % by weight may be collected as a finished low iron product.

Referring again to FIG. 6, the process 200 may include an optional step 205 wherein the incoming slag material 50 may be separated using a size classifying process into a plurality of sized groups prior to magnetic separation at step 215, such that each sized group is comprised of raw material particles within a specified size range and is processed through steps 215 through 245 (or optionally, through step 265) as one of a plurality of sized groups comprising the incoming material 50. The number of sized groups and the particle size range specified or established for each of the sized groups may vary from one lot or batch of incoming material to another, and may be established based on characteristics such as the type of slag material, particle distribution within the incoming material 50, chemistry of the batch of incoming material, etc. The size classifying may be performed using a screening system (not shown), a gyratory sifter (not shown), an air classifying system (not shown) or other size classifying system suitable to separate the incoming material 50 into the plurality of sized groups. Each of the differently sized groups may be separately fed to the magnetic separation system 100 for magnetic separation, to provide by-products which are separated by magnetic susceptibility and/or iron content and particle size. By size classifying the material 50 into a plurality of sized groups prior to using magnetic separation to separate each sized group into magnetic and non-magnetic portions 54, 52, the efficiency and effectiveness of the magnetic separation process may be increased, which may also reduce the total cost of processing the slag material 50 to yield the by-products and reduce variability of certain characteristics of each by-product such as particle size and iron content.

The examples provided herein are intended to be non-limiting. For example, it would be understood that the magnet array 48 included in an adjustable magnetic separator 10 may be adjusted to any position $L_n$, $\theta_n$ where $L_{min} \leq L_n \leq L_0$ and $\theta_{max} \geq \theta_n \geq_0$ such that the magnet array 48 in the position $L_n$, $\theta_n$ is configured to provide an effective magnetic field 30 to attract particles having a predetermined iron content or magnetic susceptibility to the separating surface 14 for removal as a magnetic portion 54. As such, the adjustable magnetic separator 10 provides numerous advantages, including the advantage of flexibility in adjusting the effective magnetic field 30 to the specific predetermined iron content or magnetic susceptibility required of the magnetic portion 54, for a particular incoming batch of material, such that the same magnetic separator 10 or same separation system 100 may be used to separate material at a first iron content, for example, a minimum iron content W %, then being adjusted to separate material at a second iron content, for example, a minimum iron content X %. The ability to adjust the position of the magnet array 48 and consequently the intensity of the effective magnetic field 30 enables use of a single separation system 100 in substitution for a series of fixed position permanent magnet separators, wherein the latter case, at least one of the fixed position permanent magnet separators would be fixedly configured to separate material at a minimum iron content W % and at least another of the fixed position permanent magnet separators would be fixedly configured to separate material at a minimum iron content X %. Another advantage may include the flexibility to adjust the effective magnetic field 30 for characteristics of the incoming material 50 which may vary from one lot of material to another and affect the efficiency of the magnetic separation, including, for example, particle size.

Figure 7:
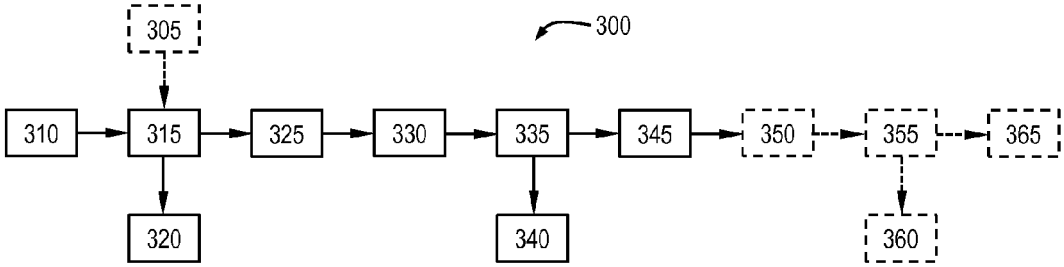
FIG. 7 is a schematic illustration of a second example process to magnetically separate an aggregate material using the magnetic separator of FIG. 1.

Referring now to FIG. 7, shown is a second example process generally indicated at 300. At a first adjustment step 310, an adjustable magnetic separation system, which may be, for example, the adjustable magnetic drum separation system 100 of FIG. 1, is provided with the adjustable magnet assembly 20 in a first position corresponding to the adjustable element 18 adjusted to an adjustment reference $L_W$ such that the magnet array 48 is positioned to a position reference $\theta_W$, e.g., the magnet array 48 is in a first position $L_W$, $\theta_W$. In the first position $L_W$, $\theta_W$, the magnet array 48 is positioned to provide a first effective magnetic field 30 characterized by a relatively stronger magnetic intensity. In the first position, $L_W \leq L_0$, $\theta_W \geq \theta_0$, and the distance between the array surface 38 and the separating surface 14 varies from $d_{W1} \ldots d_{W9}$, where $d_{W1} \leq d_0$, $d_{W2} \leq d_0$ etc. In a non-limiting example, the first position $L_W$, $\theta_W$ may be the baseline position $L_0$, $\theta_0$ shown in FIG. 4, where the adjustable member 18 is adjusted to an adjustment reference $L_0$ such that the magnet array 48 is positioned at a position reference $\theta_0$ and the array surface 38 is substantially concentric to the separating surface 14 of the drum 12 and positioned a substantially constant distance $d_0$ from the separating surface 14, e.g., each of $d_{W1} \ldots d_{W9}$ are substantially equal to $d_0$. In the baseline position $L_0$, $\theta_0$, the magnet array 40 provides a baseline effective magnetic field 30 which is characterized by a relatively stronger magnetic intensity than an effective magnetic field 30 provided by the magnet array 48 in a position where $\theta_n > \theta_0$ and $L_n < L_0$, such that the first effective magnetic field 30 may be described as an effective magnetic field 30 of relatively strong magnetic intensity. In one example, the baseline effective magnetic field 30 may be defined by a constant magnetic intensity proportional to the intensity of the array magnetic field 24 and the distance $d_0$. In one example, the relatively stronger baseline effective magnetic field 30 may define the strongest effective magnetic field 30 which may be generated by the adjustable magnet assembly 20 relative to the separating surface 14 and the configuration of the adjustment mechanism 16.

In the example shown, the adjustable magnet assembly 20 and the magnetic separator 10 is configured such that in the first position $L_W$, $\theta_W$, a first effective magnetic field 30 is generated which is configured to attract particles having a minimum iron content of W % iron by weight, such that a first magnetic portion 54 separated by the magnetic separator 10 with the magnet array 48 in the first position $L_W$, $\theta_W$ comprises particles having a minimum iron content of W %. The minimum iron content of W % may be a predetermined iron content such that the first magnetic portion 54 having an iron content of at least W % which may be characterized as an iron rich product, and may be referred to herein as iron rich material. The first non-magnetic portion 52 separated by the magnetic separator 10 with the magnet array 48 in the first position $L_W$, $\theta_W$ comprises particles having an iron content of less than W % which may be a relatively low iron content such that the first non-magnetic portion 52 is characterized as a low iron material or finished low iron product. In a non-limiting example, W % may be 30% or less iron content by weight. In one example, W % is approximately 27%. In another example, material having an iron content of less than W % may have insufficient iron content such that the material is not suitable for use as charge in an iron or steel refining operation.

At a first separation step 315, incoming material 50 including particles of varying iron content and/or magnetic susceptibility, which may be, for example, an aggregate material comprising slag, is fed into the separation system 100 with the magnet array 48 in the first position $L_W$, $\theta_W$, and is magnetically separated by the magnetic separator 10 as previously described herein into a first magnetic portion 54 having an iron content of at least W %, and a first non-magnetic portion 52 having an iron content of less than W %, where the first magnetic portion 54 is characterized as a primary iron rich material, and the first non-magnetic portion 52 is characterized as a finished low iron product.

At a collection step 320, the first non-magnetic portion 52 is collected as a finished low iron product. The finished low iron product may be suitable for use in applications requiring low ferrous content such as in the cement industry or for clinker manufacturing, and/or for use in one or more specialty applications such as blasting media, industrial absorbent, acid mine drainage neutralizer, acid mine land recovery, road traction media, and salt additive. Other applications for finished low iron product may include constituent material for cement and hot mix asphalt, use as a lime replacement, iron additive or skid resistance additive, agricultural lime replacement, or in landfills as groundcover material or roadway material. At collection step 325, the first magnetic portion 54, which is the iron rich product having an iron content of at least W %, may be collected as a primary iron rich product or may be further separated according to the process 300.

At a second adjustment step 330, an adjustable magnetic separation system 100 is provided with the adjustable magnet assembly 20 in a second position $L_X$, $\theta_X$. The separation system 100 may be the separation system 100 used in steps 310 through 325 with the adjustable magnet assembly 20 adjusted to the second position $L_X$, $\theta_X$, such that step 310 through step 345 may be completed using a single separation system 100. Alternatively, the adjustable magnet assembly 20 may be included in another separation system 100 and adjusted to the second position $L_X$, $\theta_X$. In the second position $L_X$, $\theta_X$ the magnet array 48 is positioned such that the magnet array 48 is non-concentric or skewed to the separating surface 14, as shown in FIG. 4, to generate a second effective magnetic field 30. In the second position $L_X$, $\theta_X$, the adjustable member 18 is adjusted to an adjustment reference $L_X$ where $L_{min} \leq L_X < L_W$, the magnet array 48 is positioned at a position reference $\theta_X$ where $\theta_{max} \geq \theta_W > \theta_X$ and the array surface 38 is skewed to the separating surface 14 of the drum 12 such that the distance between the array surface 38 and the separating surface 14 varies from $d_{X1} \ldots d_{X9}$, where $d_{X1} > d_{W1}$, $d_{X2} > d_{W2}$, etc. In the second position $L_X$, $\theta_X$, the magnet array 40 generates a second effective magnetic field 30 which is characterized by a relatively weaker magnetic intensity than the first effective magnetic field 30 provided by the magnet array 48 in the first position $L_W$, $\theta_W$, such that the second effective magnetic field 30 may be described as an effective magnetic field 30 of relatively weak magnetic intensity. In one example, the second effective magnetic field 30 may define the weakest effective magnetic field 30 which may be generated by the adjustable magnet assembly 20 relative to the separating surface 14, which may correspond to the adjusted position $L_{min}$, $\theta_{max}$.

In the example shown, the adjustable magnet assembly 20 and the magnetic separator 10 are configured such that in the second position $L_X$, $\theta_X$, the second effective magnetic field 30 is configured to attract particles having a minimum iron content of X % iron by weight, such that the magnetic portion 54 separated by the magnetic separator 10 with the magnet array 48 in the second position $L_X$, $\theta_X$ comprises particles having a minimum iron content of X %. The minimum iron content of X % may be a predetermined iron content such that the second magnetic portion 54 having an iron content of at least X % may be characterized as a high iron content product, which may be referred to herein as high iron material, a finished high iron product, or a primary product. The second non-magnetic portion 52 separated by the magnetic separator 10 with the magnet array 48 in the second position $L_X$, $\theta_X$ comprises particles having an iron content of less than X % and greater than W % iron, such that the second non-magnetic portion may be characterized as a secondary iron rich product. In a non-limiting example, X % may be 85% or greater iron content by weight. In one example, X % is approximately 88%. In another example, material having an iron content of greater than X % may have sufficient iron content such that the material is suitable for use as charge in an iron or steel refining operation.

At a second separation step 335, the first non-magnetic portion 52 separated at step 215 and collected as the primary iron rich material at step 335 is fed into the separation system 100 with the magnet array 48 in the second position $L_X$, $\theta_X$, and magnetically separated by the magnetic separator 10 as previously described herein into a second magnetic portion 54 having an iron content of at least X %, and a second non-magnetic portion 52 having an iron content of less than X %, where the second magnetic portion 54 is characterized as a high iron product, and the second non-magnetic portion 52 is characterized as a secondary iron rich product.

At a collection step 340, the second magnetic portion 54 is collected as a finished high iron product. The finished high iron product may be suitable, for example, as charge in an iron or steel refining or processing operation, such as a blast furnace, a sintering plant, an electric arc furnace, foundry, or ferro-alloy production process. Consumers of the finished iron rich product may include consumers of conventional pig iron and scrap. At a collection step 345, the second non-magnetic portion 52, which is an iron rich product having an iron content of less than X % by weight, may be collected as a secondary iron rich product or may optionally be further separated, for example, according to the process 300.

The process may optionally continue with steps 350 through 360. At a third adjustment step 350, an adjustable magnetic separation system 100 is provided with the adjustable magnet assembly 20 in a third position $L_Y$, $\theta_Y$. The separation system 100 may be the separation system 100 used in steps 310 through 345 with the adjustable magnet assembly 20 adjusted to the third position $L_Y$, $\theta_Y$, such that step 310 through step 345 may be completed using a single separation system 100. Alternatively, the adjustable magnet assembly 20 may be included in another separation system 100 and adjusted to the third position $L_Y$, $\theta_Y$. In the third position $L_Y$, $\theta_Y$ the magnet array 48 is positioned such that the magnet array 48 is non-concentric or skewed to the separating surface 14, as shown in FIG. 4, to generate a third effective magnetic field 30. In the third position $L_Y$, $\theta_Y$, the adjustable member 18 is adjusted to an adjustment reference $L_Y$ where $L_X<L_Y<L_W$, the magnet array 48 is positioned at a position reference $\theta_Y$ where $\theta_X>\theta_Y>\theta_W$, and the array surface 38 is skewed to the separating surface 14 of the drum 12 such that the distance between the array surface 38 and the separating surface 14 varies from $d_{Y1} \ldots d_{Y9}$, where $d_{Y1}>d_{Y1}$, $d_{Y2}>d_{Y2}$, etc. In the third position $L_Y$, $\theta_Y$, the magnet array 40 generates a third effective magnetic field 30 which is characterized by a relatively weaker magnetic intensity than the first effective magnetic field 30 provided by the magnet array 48 in the first position $L_W$, $\theta_W$ and is further characterized by a relatively stronger magnetic intensity than the second effective magnetic field 30 provided by the magnet array 48 in the second position $L_X$, $\theta_X$, such that the third effective magnetic field 30 may be described as an effective magnetic field 30 of intermediate magnetic intensity.

In the example shown, the adjustable magnet assembly 20 and the magnetic separator 10 is configured such that in the third position $L_Y$, $\theta_Y$, the third effective magnetic field 30 is configured to attract particles having a minimum iron content of Y % iron by weight, such that the magnetic portion 54 separated by the magnetic separator 10 with the magnet array 48 in the third position $L_Y$, $\theta_Y$ comprises particles having a minimum iron content of Y %. The minimum iron content of Y % may be a predetermined iron content such that the third magnetic portion 54 having an iron content of at least Y % may be characterized as a medium iron content product, which may be referred to herein as medium iron material or a finished medium iron product. The third non-magnetic portion 52 separated by the magnetic separator 10 with the magnet array 48 in the third position $L_Y$, $\theta_Y$ comprises particles having an iron content of less than Y % and greater than W % iron, such that the third non-magnetic portion may be characterized as low-to-medium iron product. In a non-limiting example, Y % may be 55% or greater iron content by weight. In one example, Y % is approximately 60%. In another example, the third magnetic portion 54 may have an iron content of greater than Y % and less than X % such that the material is characterized by a specific gravity in a predetermined range rendering it suitable for use as counterweight filler material.

At a third separation step 355, the second non-magnetic portion 52 separated at step 335 and collected as a secondary iron rich material at step 345 is fed into the separation system 100 with the magnet array 48 in the third position $L_Y$, $\theta_Y$, and magnetically separated by the magnetic separator 10 as previously described herein into a third magnetic portion 54 having an iron content of at least Y %, and a second non-magnetic portion 52 having an iron content of less than Y %, where the third magnetic portion 54 is characterized as a medium iron product, and the second non-magnetic portion 52 may be characterized as low-to-medium iron product.

At a collection step 360, the third magnetic portion 54 is collected as a finished medium iron product. The finished medium iron product may be suitable, for example, for use in one or more specialty applications such as counterweight material or applications in the coal processing industry. At a collection step 365, the third non-magnetic portion 52 having an iron content of less than Y % by weight may be collected as a low-to-medium iron product. In one example, the third magnetic portion 52, e.g., the low-to-medium iron product may be further processed to provide particles of increased iron content, by grinding or other processing intended to liberate particles of increased iron content. The third non-magnetic portion 52 may be magnetically separated, for example, using the adjustable separation system 100 configured to separate the third non-magnetic portion 52 into a fourth magnetic portion 54 having a predetermined minimum iron content of Z % and a fourth non-magnetic portion 52, where the adjustable magnet assembly 20 would be configured for this fourth separation step to attract particles having the predetermined minimum iron content of Z % to the separating surface 14.

Referring again to FIG. 7, the process 300 may include an optional step 305 wherein the incoming slag material 50 may be separated using a size classifying process into a plurality of sized groups prior to magnetic separation at step 315, such that each sized group is comprised of raw material particles within a specified size range and is processed through steps 315 through 345 (or optionally, through step 365) as one of a plurality of sized groups comprising the incoming material 50. The number of sized groups and the particle size range specified or established for each of the sized groups may vary from one lot or batch of incoming material to another, and may be established based on characteristics such as the type of slag material, particle distribution within the incoming material 50, chemistry of the batch of incoming material, etc. The size classifying may be performed using a screening system (not shown), a gyratory sifter (not shown), an air classifying system (not shown) or other size classifying system suitable to separate the incoming material 50 into the plurality of sized groups. Each of the differently sized groups may be separately fed to the magnetic separation system 100 for magnetic separation, to provide by-products which are separated by magnetic susceptibility and/or iron content and particle size. By size classifying the material 50 into a plurality of sized groups prior to using magnetic separation to separate each sized group into magnetic and non-magnetic portions 54, 52, the efficiency and effectiveness of the magnetic separation process may be increased, which may also reduce the total cost of processing the slag material 50 to yield the by-products and reduce variability of certain characteristics of each by-product such as particle size and iron content.

The examples shown in FIGS. 1-7 and described herein are not intended to be limiting. Other configurations of adjustment mechanism 16 are possible, which may include one or more elements which may be substituted for one or more of the attachments 44, 46 and/or the adjustable element 18, and may include, for example, one or more of a hinge, a locking hinge, a lever, a gear, a cam, etc. which may be mechanically movable and/or adjustable to position the magnet array 48 relative to the support member 70 and to modify the position of the magnet array 48 relative to the separating surface 14 of the separating member 12. The plurality of permanent magnet elements 22 may be substantially the same, such that each is defined by substantially the same shape, size, chemistry, intensity etc. Other configuration of the magnet array 48 are possible, including configurations where the plurality of permanent magnet elements 22 comprising the magnet array 48 include a combination of permanent magnet elements which may differ from each other in at least one of shape, size, chemistry, intensity, etc. to define the array magnetic field 24. In one example, the permanent magnet elements 22 may be configured and/or arranged to define an array magnetic field 24 of varying intensity, such that the intensity of at least one of the fixed magnetic fields 24*a* . . . 24*i* differs from the intensity of another of the fixed magnetic fields 24*a* . . . 24*i*.

Other configurations of the system and methods described herein are possible, and the examples provided herein, including the example of an adjustable magnetic drum separator configured to process slag materials, are not intended to be limiting. For example, the adjustable magnet 20 may be included in other configurations of an adjustable magnetic separator 10 and/or magnetic separation system 100. For example, the adjustable magnet may be configured for use in various types of magnetic separators including but not limited to magnetic rotary drum separators including top feed, side feed, suspended drum and double drum separators, magnetic pulleys or pulley magnets, and magnetic conveyor or magnetic belt separators including in-line and cross-belt separators. The term arcuate, as used herein, is not intended to be limited to substantially circular configurations and may include generally oval or elliptical arrangements of the magnet elements 22 into a non-circular arcuate pattern. The magnet array 48 may be configured as to define a substantially planar or flat array surface 38, wherein in a first position the array surface 38 is substantially parallel to the separating surface 14, for example, for inclusion in an adjustable magnetic assembly 20 configured for use in a magnetic belt separation system such as an in-line or cross-line belt separator system. In the example of a substantially planar magnet array 48, the adjustment mechanism may be configured to adjust the array 48 from the first position to at least a second position, where the array surface 38 in the at least second position is substantially parallel to but at a different distance from the separating surface 14 relative to the first position. In another example where the magnet array 48 is a substantially parallel to the separating surface 14 in a first position, the adjustment mechanism may be configured to adjust the array 48 from the first position to at least a second position where the array surface 38 in the at least second position is substantially non-parallel or skew to the separating surface 14 and/or at a different distance from the separating surface 14 in the at least second position.

While the best modes for carrying out the invention have been described in detail, those familiar with the art to which this invention relates will recognize various alternative designs and embodiments for practicing the invention within the scope of the appended claims.

The invention claimed is:

1. An adjustable magnet configured for use in a magnetic separator, the adjustable magnet comprising:

a magnet array including a plurality of permanent magnets defining an arcuate magnet array surface and configured to provide an array magnetic field;

the magnet array defining a leading end and a trailing end;

an adjustment mechanism including a mounting bracket, a first arm, and a second arm;

wherein the mounting bracket is fixedly attachable to a fixed member of the magnetic separator;

wherein the first arm is:

adjustable in length, pivotally attached at a first end to the mounting bracket, and pivotally attached at a second end to one of the leading end and the trailing end of the magnet array;

wherein the second arm is:

pivotally attached at a first end to the mounting bracket, and pivotally attached at a second end to the other of the leading end and the trailing end of the magnet array;

wherein the first arm and the second arm are each pivotable relative to the mounting bracket and to each other to position the arcuate magnet array surface adjacent to a separating surface defined by the magnetic separator;

wherein the location of the separating surface is defined relative to the fixed member;

wherein the position of the arcuate magnet array surface relative to the separating surface is adjustable to a plurality of positions by adjusting the length of the first arm; and wherein an effective magnetic field is defined at the separating surface by the array magnetic field and the position of the arcuate magnet array surface relative to the separating surface.

2. The adjustable magnet of claim 1, wherein:

the plurality of positions includes a first position and a second position; and the intensity of the effective magnetic field when the magnet array is in the first position is relatively stronger than the intensity of the effective magnetic field when the magnet array is in the second position.

3. The adjustable magnet of claim 2, wherein:

the plurality of positions includes a third position; and the intensity of the effective magnetic field when the magnet array is in the third position is relatively weaker than the intensity of the effective magnetic field when the magnet array is in the first position and relatively stronger than the intensity of the effective magnetic field when the magnet array is in the second position.

4. The adjustable magnet of claim 1, wherein:

the arcuate magnet array surface includes a trailing array surface defined by the trailing end of the magnet array, a leading array surface defined by the leading end of the magnet array, and a central array surface intermediate the trailing and leading array surfaces;

the separating surface is separated from the magnet array surface by a radial distance;

the position of the magnet array is adjustable to a first position such that the radial distance separating the separating surface from each of the leading, trailing and central array surfaces is equidistant;

the position of the magnet array is adjustable to a second position such that the radial distance separating the separating surface from the arcuate magnet array surface is variable; and wherein in the second position:

the separating surface is separated from the leading array surface by a first radial distance;

the separating surface is separated from the trailing array surface by a second radial distance, and the separating surface is separated from the central array surface by a third distance;

wherein the third distance is greater than the first distance and greater than the second distance.

5. The adjustable magnet of claim 1, wherein: the magnet array is adjustable such that the arcuate magnet array surface is skewed relative to the separating surface.

6. The adjustable magnet of claim 1, wherein:

the array magnetic field is characterized by a constant intensity;

the effective magnetic field is characterized by a constant intensity when the magnet array is in a first position; and the effective magnetic field is characterized by a variable intensity when the magnet array is in a second position.

7. The adjustable magnet of claim 1, wherein the first arm includes one of an adjustable rod, a cam, a jack screw, a turnbuckle, and a hinge adjustable to adjust the length of the first arm.

8. A method of magnetically separating an incoming material using a magnetic separator, the method comprising:

adjusting an array surface defined by a permanent magnet array of the magnetic separator to a first position using an adjustment mechanism configured to adjust the position of the array surface relative to a separating surface of the magnetic separator to provide an effective magnetic field at the separating surface;

wherein the effective magnetic field is defined at the separating surface by an array magnetic field defined by the permanent magnet array and the position of the array surface relative to the separating surface;

wherein:

the magnet array defines an arcuate magnet array surface, a leading edge, and a trailing edge;

the adjustment mechanism includes a mounting bracket, a first arm, and a second arm;

the mounting bracket is fixedly attached to a fixed member of the magnetic separator;

the first arm is:

adjustable in length, pivotally attached at a first end to the mounting bracket, and pivotally attached at a second end to one of the leading end and the trailing end of the magnet array;

the second arm is:

pivotally attached at a first end to the mounting bracket, and pivotally attached at a second end to the other of the leading end and the trailing end of the magnet array;

the first arm and the second arm are each pivotable relative to the mounting bracket and to each other to position the magnet array surface adjacent to the separating surface;

the adjustment mechanism is configured to adjust the position of the array surface relative to the separating surface to a plurality of positions including the first position by adjusting the length of the first arm;

adjusting the array surface to the first position defines a first effective magnetic field at the separating surface;

the method further comprising:

adjusting the length of the first arm to adjust the array surface to the first position; and introducing the incoming material to the separating surface with the array surface in the first position to magnetically separate the incoming material into a first magnetic portion and a first non-magnetic portion.

9. The method of claim 8, further comprising:

adjusting the array surface to a second position using the adjustment mechanism, to provide a second effective magnetic field having a different magnetic intensity than the first effective magnetic field; and introducing the incoming material to the separating surface with the array surface in the second position to magnetically separate the incoming material into a second magnetic portion and a second non-magnetic portion;

wherein the second magnetic portion is characterized by a magnetic susceptibility different than the first magnetic portion and corresponding to the second effective magnetic field.

10. The method of claim 9, wherein:

the incoming material introduced to the separating surface with the array surface in the second position is the first magnetic portion.

11. The method of claim 9, wherein:

the incoming material is a slag material;

the first magnetic portion defines a finished high iron product; and the second magnetic portion defines a finished medium iron product.

12. The method of claim 9, wherein:

at least one of the first and second effective magnetic fields is characterized by a variable intensity at the separating surface; and the variable intensity of the at least one of the first and second effective magnetic fields is characterized by:

a first intensity defined at the separating surface by the array magnetic field and the position of the leading end of the magnet array relative to the separating surface;

a second intensity defined at the separating surface by the array magnetic field and the position of the trailing end of the magnet array relative to the separating surface; and a third intensity defined at the separating surface by the array magnetic field and the position of a central portion of the magnet array intermediate the leading and trailing ends of the magnet and relative to the separating surface; and the third intensity is less than each of the first and second intensities.

13. The method of claim 8, further comprising:

classifying the incoming material prior to providing the incoming material to the separating surface such that the particle size of the incoming material is within a predetermined size range.

14. A magnetic separator comprising:

a separating surface;

a permanent magnet array including a leading end and a trailing end;

the magnet array defining an arcuate magnet array surface and configured to provide an array magnetic field;

an adjustable mechanism configured to adjust the position of the arcuate magnet array surface relative to the separating surface between a plurality of positions; and wherein:

an effective magnetic field is defined at the separating surface by the array magnetic field and the position of the arcuate magnet array surface relative to the separating surface;

the effective magnetic field is characterized by a constant intensity at the separating surface when the arcuate magnet array surface is adjusted to one of the plurality of positions;

the effective magnetic field is characterized by a variable intensity at the separating surface when the array surface is adjusted to another of the plurality of positions; and with the magnet array in the another position the variable intensity of the effective magnetic field at the separating surface is characterized by:

a first intensity defined at the separating surface by the array magnetic field and the position of the leading end of the arcuate magnet array relative to the separating surface;

a second intensity defined at the separating surface by the array magnetic field and the position of the trailing end of the magnet array relative to the separating surface; and a third intensity defined at the separating surface by the array magnetic field and the position of a central portion of the magnet array intermediate the leading and trailing ends of the magnet and relative to the separating surface;

wherein the third intensity is less than each of the first and second intensities.

15. The magnetic separator of claim 14, wherein:

the plurality of positions includes a first position and a second position; and the effective magnetic field defined by the magnet array in the first position is configured to attract magnetic particles having a first magnetic susceptibility to separate material incoming to the magnetic separator into a first magnetic portion and a first non-magnetic portion; and the effective magnetic field defined by the magnet array in the second position is configured to attract magnetic particles having a second magnetic susceptibility to separate one of the first magnetic portion and the first non-magnetic portion into a second magnetic portion and a second non-magnetic portion.

16. The magnetic separator of claim 14, wherein:

the magnetic separator is configured as a drum separator; and the rotatable drum is configured to define the separating surface.

17. The magnetic separator of claim 14, wherein:

the adjustment mechanism includes a mounting bracket, a first arm, and a second arm;

the mounting bracket is fixedly attached to a fixed member of the magnetic separator;

the first arm is:

adjustable in length, pivotally attached at a first end to the mounting bracket, and pivotally attached at a second end to one of the leading end and the trailing end of the magnet array;

the second arm is:

pivotally attached at a first end to the mounting bracket, and pivotally attached at a second end to the other of the leading end and the trailing end of the magnet array;

the first arm and the second arm are each pivotable relative to the mounting bracket and to each other to position the magnet array surface adjacent to the separating surface;

the adjustment mechanism is configured to adjust the position of the array surface relative to the separating surface to a plurality of positions including the first position by adjusting the length of the first arm.

18. The adjustable magnet of claim 2, wherein with the magnet array in the second position the variable intensity of the effective magnetic field at the separating surface is characterized by:

a first intensity defined at the separating surface by the array magnetic field and the position of the leading end of the magnet array relative to the separating surface;

a second intensity defined at the separating surface by the array magnetic field and the position of the trailing end of the magnet array relative to the separating surface; and a third intensity defined at the separating surface by the array magnetic field and the position of a central portion of the magnet array intermediate the leading and trailing ends of the magnet and relative to the separating surface;

wherein the third intensity is less than each of the first and second intensities.

19. The adjustable magnet of claim 1, wherein the second arm is adjustable in length such that the position of the magnet array surface relative to the separating surface is adjustable to a plurality of positions by adjusting the length of either of the first arm and the second arm.

20. The adjustable magnet of claim 1, wherein:

the mounting bracket defines a first pivot;

the first ends of the first and second arms are pivotally attached to the first pivot such that the first and second arms are pivotable relative to the first pivot and to each other.

* * * * *